US006273660B1

(12) United States Patent
Ozgen et al.

(10) Patent No.: US 6,273,660 B1
(45) Date of Patent: Aug. 14, 2001

(54) FLEXIBLE MAGNETIC INSERTS FOR BINDING INTO MAGAZINES OR PERIODICALS

(75) Inventors: Mehmet Sami Ozgen, Palatine; Chris Bohlin, Chicago, both of IL (US)

(73) Assignee: Bassitt Enterprises, Chicago, IL (US)

( * ) Notice: Subject to any disclaimer, the term of this patent is extended or adjusted under 35 U.S.C. 154(b) by 0 days.

(21) Appl. No.: 09/587,548

(22) Filed: Jun. 1, 2000

(51) Int. Cl.[7] ..... B42C 11/00

(52) U.S. Cl. ..... 412/1; 412/6; 283/56; 281/38; 281/51; 281/DIG. 1; 402/503

(58) Field of Search ..... 283/66.1, 56, 51; 281/38, 51, DIG. 1; 402/503; 40/621, 600; 434/168; 412/1, 6

(56) References Cited

U.S. PATENT DOCUMENTS 4,580,360 * 4/1986 Gribb ..... 281/DIG. 1
5,004,270 * 4/1991 Schaul et al. ..... 283/56 X
5,269,563 * 12/1993 Michlin ..... 281/38
5,713,605 * 2/1998 Pace ..... 281/38
5,813,154 * 9/1998 Wilford ..... 40/621 X
5,868,498 * 2/1999 Martin ..... 40/600

* cited by examiner

*Primary Examiner*—Willmon Fridie, Jr.
(74) *Attorney, Agent, or Firm*—Dennis A. Gross; The Hill Firm

(57) ABSTRACT

A flexible magnetic insert for a magazine or a periodical is provided which may be bound directly into the magazine or periodical and which provides a plurality of individual magnetized advertisements or coupons that can be removed and placed upon a metal surface such as a refrigerator or file cabinet. The magnetized sheet includes advertising, informational or decorative indicia on both its top and bottom sides. The sheet is perforated so that the individualized advertisements or coupons can be easily separated. The present invention provides an improved means for distributing magnetized advertisements and coupons.

14 Claims, 3 Drawing Sheets

FLEXIBLE MAGNETIC INSERTS FOR BINDING INTO MAGAZINES OR PERIODICALS

FIELD OF THE INVENTION

The present invention relates generally to flexible magnetic sheets for use as advertisements or coupons and that are commonly referred to as "refrigerator magnets". The present invention also relates generally to inserts or advertisements for magazines and periodicals. More specifically, the present invention relates to a flexible magnetic sheet that can be bound into a magazine or periodical and that can be perforated to provide a plurality of coupons or individual advertisements.

BACKGROUND OF THE INVENTION

Magazines and periodicals, of course, are known. Further, it is also known to include loose inserts in the form of coupons, advertisements and subscription cards in magazines and periodicals. FIG. 1 illustrates a magazine 10 and FIGS. 4 and 5 illustrate the front and back sides of a subscription card 20 of the type which are loosely slid between pages of a magazine 10. This type of loose leaf advertising is also used in newspapers.

In general, magazines and periodical subscribers have become frustrated with the advent of loose coupons, advertisements and other materials being placed inside the magazines and periodicals. The loose materials slide out between the pages and often fall on the floor. In an effort to remedy this situation, magazines and periodicals often bind the inserts, such as subscription coupons into the magazine thereby preventing the items from falling out during subsequent use.

Flexible magnets that can be easily secured to a refrigerator or a file cabinet (also known as "refrigerator magnets") are also known. FIGS. 2 and 3 illustrate the front and back sides respectively of one such refrigerator magnet 30. The front side 31 includes a plurality of advertising or other informational indicia. The magnet 30 can also take the form of a redeemable coupon. The back side 32 of the magnet 30 as shown in FIG. 3 is typically a dark brown or black color. Because this space abuts the refrigerator or file cabinet when the magnet is in place on the refrigerator or file cabinet, the prior art magnets do not use the back side 32 for additional advertising or informational indicia.

Magnetized coupons and advertisements have become very popular in the United States in wake of the popularity of large or full sized refrigerators. Magnetized coupons and advertisements are often decorative and become a welcome addition on a refrigerator or file cabinet along side souvenir magnets. Despite the growing popularity of magnetized coupons and advertisements, they have not been employed or distributed to a significant extent in magazines and periodicals. If an economical and aesthetically pleasing scheme for distributing magnetized advertisements and coupons in magazines and periodicals could be developed, such a scheme would further enhance the use of these popular advertisement vehicles.

SUMMARY OF THE INVENTION

The present invention satisfies the aforenoted need by providing a flexible magnetic insert for a magazine that comprises a magnetic sheet having a top side and a bottom side. The top side of the magnetic sheet is printed with indicia such as informational indicia or advertising indicia.

Similarly, the bottom side of the magnetic sheet may also be printed with indicia, such as advertising or informational indicia or simply decorative indicia. The sheet is capable of being bound into the magazine or periodical or otherwise attached to the magazine or periodical with glue or adhesive.

In a preferred embodiment, the magnetic sheet is perforated so that a single sheet can provide a plurality of magnetized advertisements or coupons. In such an embodiment, the magnetic sheet is perforated so that four detachable magnetized advertisements or coupons are provided. In other embodiments, the magnetic sheet is perforated so that six or eight separate magnetized coupons or advertisements are provided in a single sheet.

In an embodiment, the magnetic sheet is not perforated but includes a plurality of different designs that can be cut out by the consumer utilizing scissors or other cutting tools.

In an embodiment, the bottom side of the magnetic sheet is blank but is covered with a non-magnetic laminate which, in turn, is printed with indicia, such as advertising or informational indicia or simply decorative indicia. In such an embodiment, the non-magnetic laminate sheet may be removable from the bottom side of the magnetic sheet or may be permanently attached thereto. If the non-magnetic laminate sheet is permanently attached to the bottom side of the magnetic sheet, the magnet must be strong enough to enable the magnetic sheet to stick to a metallic surface with the non-magnetic laminate sheet disposed between the bottom side of the magnetic sheet and the metallic surface.

In an embodiment, the magnetic sheet has an inner edge which is bound into the magazine or periodical. Further, a perforation is disposed inside the inner edge and between the inner edge and the bulk portion of the magnetic sheet thereby enabling the entire magnetic sheet to be removed from the magazine or periodical or also allowing the individual magnetized advertisements or coupons to be removed one by one.

In an embodiment, the present invention provides a method for providing a plurality of removable flexible magnetic advertisements or coupons in a magazine or periodical. The method of the present invention comprises the steps of providing a flexible magnetic sheet having a top side and a bottom side with both the top and bottom sides printed with indicia. The magnetic sheet has an inside edge which is bound into the magazine or periodical. A perforation is provided along the inside edge and additional perforations are provided in the bulk portion of the magnetic sheet thereby providing a plurality of detachable magnetized advertisements or coupons which can be easily removed from the magazine or periodical.

Other advantages and objects of the present invention will become apparent upon reading the following detailed description and appended claims, and upon reference to the accompanying drawings.

BRIEF DESCRIPTION OF THE DRAWINGS

The invention is illustrated more or less diagrammatically in the following drawings wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
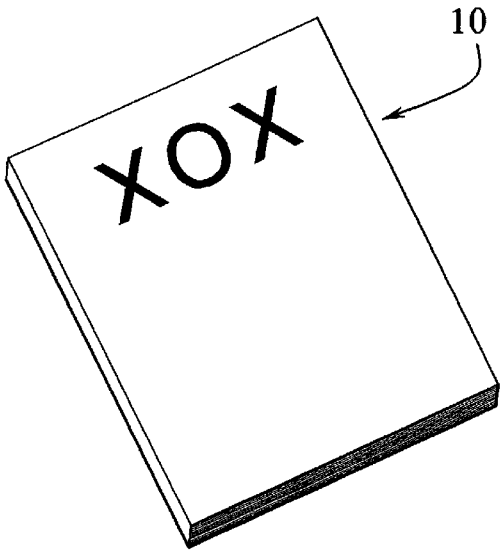
FIG.1 (PRIOR ART)
FIG. 1 is a perspective view of a magazine or periodical known in the art.
Figure 2:
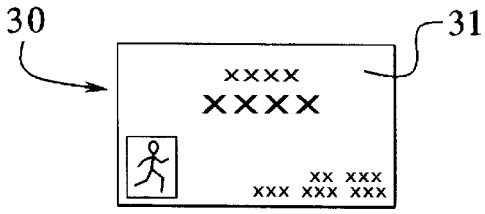
FIG.2 (PRIOR ART)
FIG. 2 is a top side view of a magnetized advertisement or coupon that is known in the art.
Figure 3:
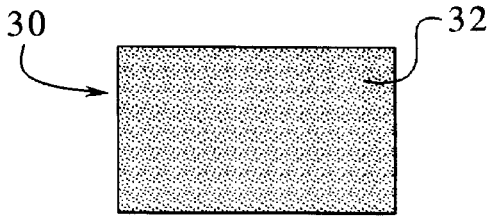
FIG.3 (PRIOR ART)
FIG. 3 is a bottom side view of the magnetized advertisement or coupon shown in FIG. 2, also known in the art.
Figure 4:
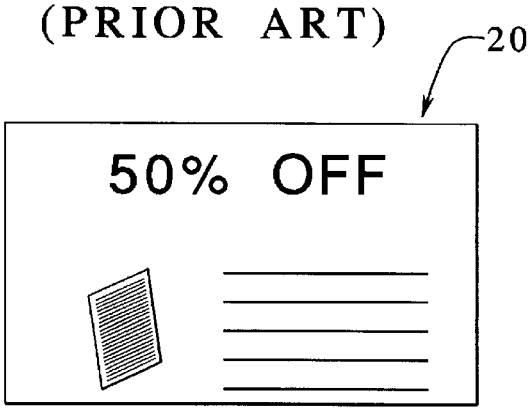
FIG.4 (PRIOR ART)
FIG. 4 is a top side view of a loose coupon or insert for a magazine or periodical, that is known in the art.
Figure 5:
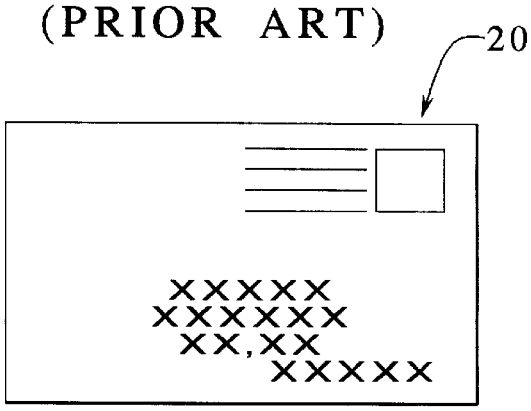
FIG.5 (PRIOR ART)
FIG. 5 is a bottom side view of the loose coupon or advertisement shown in FIG. 4.
Figure 6:
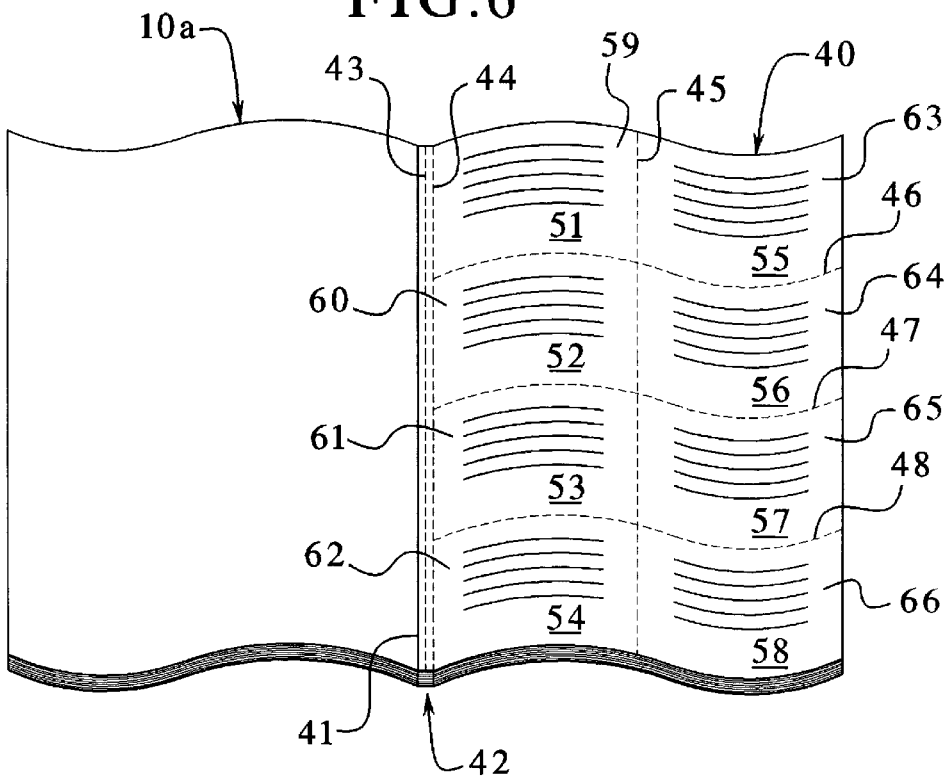
FIG. 6 is a plan view of a magazine or periodical, in an open position and illustrating, in plan view, a magnetized sheet that comprises a plurality of individual magnetized advertisements or coupons made in accordance with the present invention.

Turning to FIG. 6, a magazine 10*a* is illustrated in which is bound a magnetized sheet 40. The magnetized sheet 40 includes an inner edge 41 that is attached to the binding 42 of the magazine 10*a*. Along the inside edge 41 is a perforation 43 which enables the bulk portion of the magnetized sheet 40 to be removed from the magazine 10*a*. The magnetized sheet 40 also includes perforations 44—48 which divides the magnetized sheet 40 into eight different magnetized coupons or advertisements. As a result, eight different advertisers can be served by a single sheet 40. Of course, any number of perforations can be provided and the number of individual advertisers served can range anywhere from one to eight or more.

Figure 7:
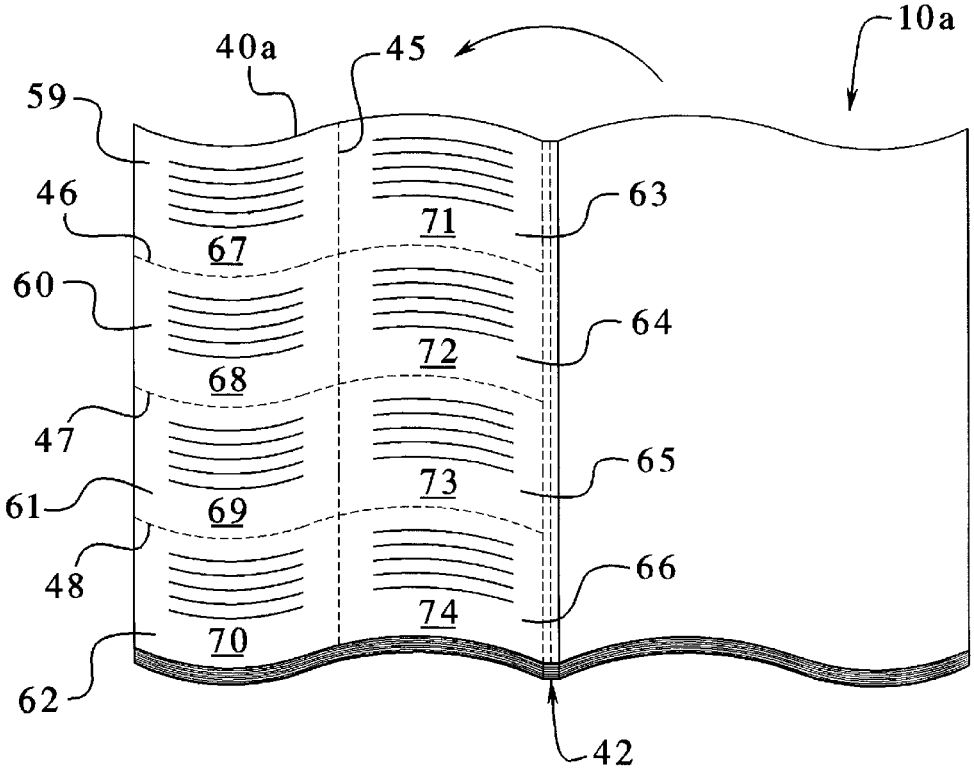
FIG. 7 is a plan view of the magazine and magnetized sheet of coupons or advertisements shown in FIG. 6 with the magnetized sheet of coupons or advertisements flipped over thereby showing the back side thereof.

It will be noted that the front side 51—58 of each individualized advertisement or coupon 59—66 is printed with either informational, advertising or decorative indicia. Turning to FIG. 7, it will also be noted that each back side 67—74 of each individual magnetized advertisement or coupon 59—66 is also printed with advertising, informational or decorative indicia. Thus, both sides of the magnetized sheet 40 are utilized and no dark brown or black blank side is presented, which would be unattractive to both the consumer and the publisher.

Figure 8:
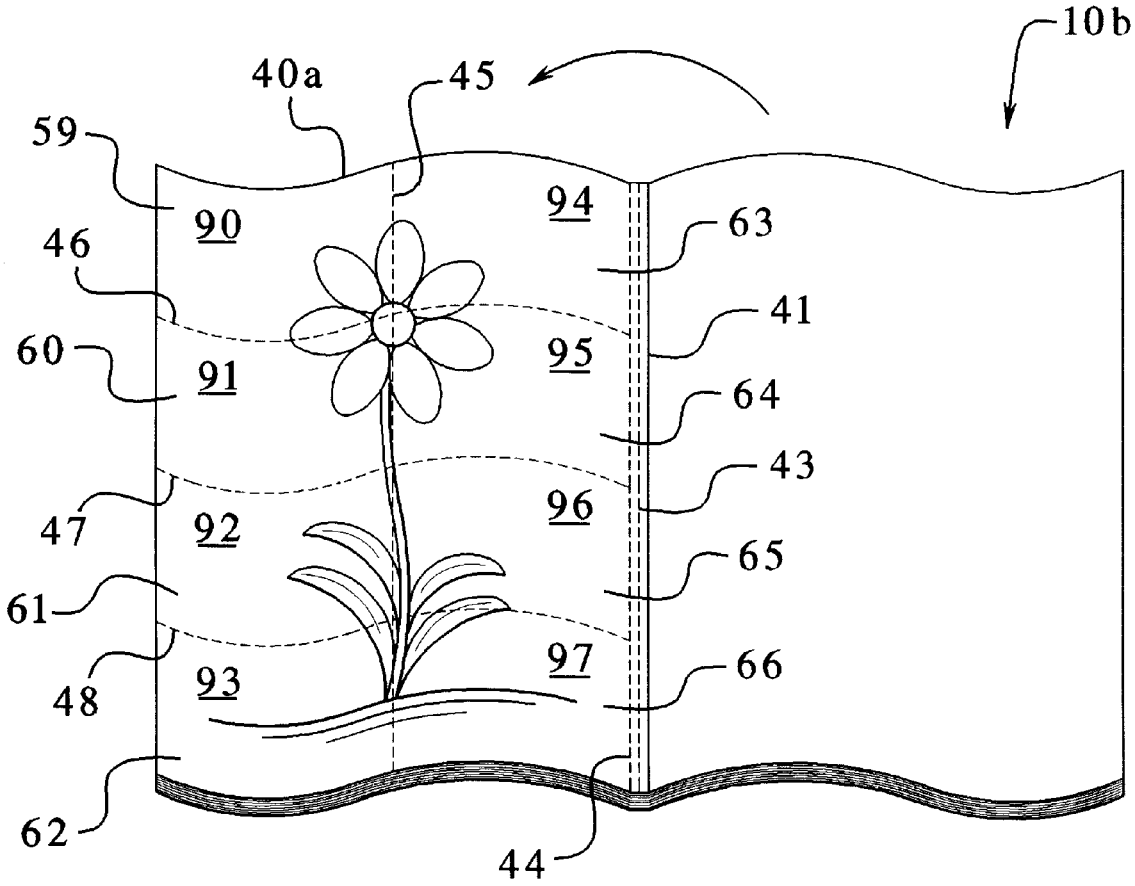
FIG. 8 illustrates an alternative embodiment of a back side of a magnetized sheet of advertisements or coupons also made in accordance with the present invention.

As an alternative, FIG. 8 illustrates a magazine 10*b* which is equipped with a magnetized sheet 40*a* with cumulative back sides 90—97 that include decorative indicia only. Because once the individualized magnetized coupons or advertisements 59—66 are removed from the magazine 10*b* and placed on a refrigerator or file cabinet, the decorative back sides 90—97 will not be in view but, instead, will abut against a metal surface such as a refrigerator door or a file cabinet.

Suitable magnetic material for use with the present invention is readily available and suppliers will be known to those skilled in the art.

As noted above, the sheet 40 may be bound into the binding of the magazine or simply attached to the magazine with glue or other adhesive. Further, the sheet 40 need not be perforated. For example, several novelty designs may be provided on a single unperforated sheet 40 and the consumer would be able to cut individual novelty designs out of the sheet 40 with scissors or another cutting device. Further, the back side of the sheet 40 may be unprinted or may be covered with a non-magnetic layer that is either printed or unprinted. Further, if the sheet 40 is perforated, the individual items need not be of a rectangular shape as shown in FIGS. 6—8. Instead, irregular shapes can be provided as well.

From the above description, it is apparent that the advantages and objects of the present invention have been achieved. While only certain embodiments have been set forth, alternative embodiments and various modifications will be apparent from the above description to those skilled in the art.

What is claimed:

1. A method of providing a plurality of removable flexible magnetic advertisements in a magazine or periodical, the method comprising the following steps:

providing a flexible magnetic sheet having a top side and a bottom side, the top side being printed with indicia and being nonmagnetic, the bottom side being printed with indicia and being magnetic, the magnetic sheet further comprising and inside edge, the magnetic sheet also comprising a perforation disposed parallel to the inside edge and between the inside edge and a bulk portion of the magnetic sheet thereby permitting the bulk portion of the magnetic sheet to be detached from inside edge of the magnetic sheet, the bulk portion of magnetic sheet being perforated so that the bulk portion of the magnetic sheet is divisible into at least two separate and smaller magnetic sheets; and attaching the inside edge of the flexible magnetic sheet to the binding of the magazine or periodical.

2. The method of claim 1 wherein the magnetic sheet is perforated between the inside edge and the bulk portion so that the bulk portion of the magnetic sheet is divisible into at least four separate and smaller magnetic sheets.

3. The method of claim 1 wherein the magnetic sheet is perforated between the inside edge and the bulk portion so that the bulk portion of the magnetic sheet is divisible into at least six separate and smaller magnetic sheets.

4. A flexible magnetic insert for a magazine or periodical having a binding, the insert comprising: a flexible magnetic sheet having a top side and a bottom side, top side being printed with indicia, the sheet having inside and outside edges, the inside edge adapted to be bound into the magazine or periodical, a line of perforations closely spaced from the inside edge and substantially parallel thereto whereby the remainder of the sheet can be separated from the inside edge.

5. The flexible magnetic insert of claim 4 wherein the bottom side is printed with indicia.

6. The flexible magnetic insert of claim 4 wherein the remainder of the remainder of the magnetic sheet is perforated so that the sheet is divisible into at least two separate and smaller magnetic sheets.

7. The flexible magnetic insert of claim 4 wherein the remainder of the magnetic sheet is perforated so that the sheet is divisible into at least four separate and smaller magnetic sheets.

8. The flexible magnetic insert of claim 4 wherein the remainder of the magnetic sheet is perforated so that the sheet is divisible into at least six separate and smaller magnetic sheets.

9. The flexible magnetic insert of claim 4 wherein the remainder of the magnetic sheet is perforated so that the sheet is divisible into at least eight separate and smaller magnetic sheets.

10. The flexible magnetic insert of claim 6 wherein the bottom side is printed with indicia.

11. The flexible magnetic insert of claim 7 wherein the bottom side is printed with indicia.

12. The flexible magnetic insert of claim 8 wherein the bottom side is printed with indicia.

13. The flexible magnetic insert of claim 9 wherein the bottom side is printed with indicia.

14. The flexible magnetic insert of claim 10 wherein the bottom side is printed with indicia.

* * * * *